US005974840A

United States Patent [19]

Kao

[11] Patent Number: 5,974,840

[45] Date of Patent: Nov. 2, 1999

[54] ANTI-THEFT DEVICE FOR PERSONAL COMPUTERS

[76] Inventor: Tom M. Kao, 4579 180th St., Clinton, Iowa 52732

[21] Appl. No.: 08/915,222

[22] Filed: Aug. 20, 1997

[51] Int. Cl.[6] ..... E05B 73/00

[52] U.S. Cl. ..... 70/58; 248/551; 70/18; 70/14

[58] Field of Search ..... 70/58, 18, 14, 70/57, 63, 30, 49; 248/551

[56] References Cited

U.S. PATENT DOCUMENTS

| | | | |
|---|---|---|---|
| 3,625,031 | 12/1971 | Alley, III | 70/58 |
| 3,664,163 | 5/1972 | Foote | 70/58 |
| 4,038,843 | 8/1977 | Daley, Jr. | 70/58 |
| 4,118,902 | 10/1978 | Saxton | 70/58 |
| 4,448,049 | 5/1984 | Murray | 70/58 |
| 4,562,707 | 1/1986 | Graham, III | 70/58 |
| 4,733,840 | 3/1988 | D'Amore . | |
| 4,738,428 | 4/1988 | Themistos et al. | 70/58 |
| 4,951,577 | 8/1990 | Bentley | 70/58 |
| 5,184,798 | 2/1993 | Wilson | 248/551 |
| 5,351,507 | 10/1994 | Derman . | |
| 5,361,610 | 11/1994 | Sanders | 70/58 |
| 5,406,809 | 4/1995 | Igelmund . | |
| 5,501,086 | 3/1996 | Sherlock | 70/58 |
| 5,502,989 | 4/1996 | Murray et al. | 70/58 |
| 5,520,031 | 5/1996 | Davidge . | |
| 5,579,657 | 12/1996 | Makous . | |
| 5,595,073 | 1/1997 | Sullivan | 70/58 |

FOREIGN PATENT DOCUMENTS

| | | | |
|---|---|---|---|
| 977987 | 11/1975 | Canada | 70/18 |

*Primary Examiner*—Darnell M. Boucher
*Attorney, Agent, or Firm*—Henderson & Sturm

[57] ABSTRACT

A device and method for deterring the theft of personal computers having an unused serial or parallel port. An eyelet bolt is screwed into each of the threaded apertures adjacent the unused port and the eyelets are then secured to some relatively immovable object by a chain or steel cable. The chain or steel cable may simply pass through the eyelets or may be secured to the eyelets with a padlock, in either case preventing the eyelets from rotating and being removed from the computer. The opposite end of the cable or chain may simply be wrapped around the immovable object or locked to it as by a second pair of eyelets screwed into the lower surface of the computer desk.

2 Claims, 2 Drawing Sheets

ANTI-THEFT DEVICE FOR PERSONAL COMPUTERS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to personal computers, and more particularly to an apparatus for deterring the theft of personal computers.

2. Description of the Related Art

As can be seen by reference to U.S. Pat. Nos. 4,733,840; 5,351,507; 5,406,809; 5,520,031; and 5,579,657; the prior art is replete with myriad and diverse devices for deterring the theft of personal computers, monitors, printers and the like. While all of these aforementioned prior art devices are adequate for the basic purpose and function for which they have been specifically designed they are all uncessarily complex and expensive.

Those concerned with these and other problems recognize the need for an improved apparatus for securing personal computers.

BRIEF SUMMARY OF THE INVENTION

The present invention discloses a device for deterring the theft of personal computers having an unused serial or parallel port. An eyelet bolt is screwed into each of the threaded apertures adjacent the unused port and the eyelets are then secured to some relatively immovable object by a chain or steel cable. The chain or steel cable may simply pass through the eyelets or may be secured to the eyelets with a padlock, in either case preventing the eyelets from rotating and being removed from the computer. The opposite end of the cable or chain may simply be wrapped around the immovable object or locked to it as by a second pair of eyelets screwed into the lower surface of the computer desk.

BRIEF DESCRIPTION OF THE SEVERAL VIEWS OF THE DRAWINGS

Other objects, advantages, and novel features of the present invention will become apparent from the following detailed description of the invention when considered in conjunction with the accompanying drawings, wherein.

DETAILED DESCRIPTION OF THE INVENTION

Figure 1:
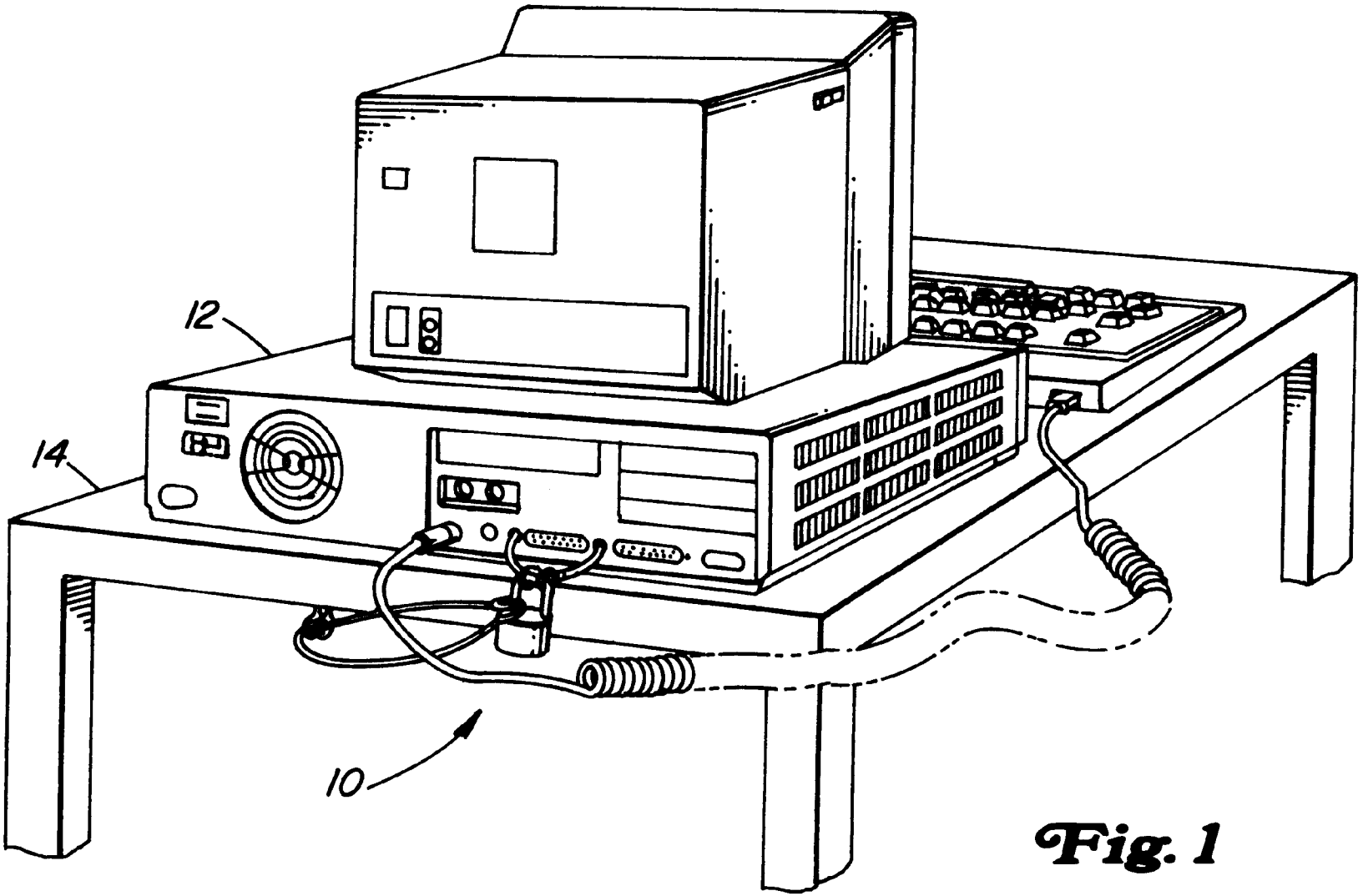
FIG. 1 is a perspective view of the rear of a personal computer with a first embodiment of the invention in place.
Figure 2:
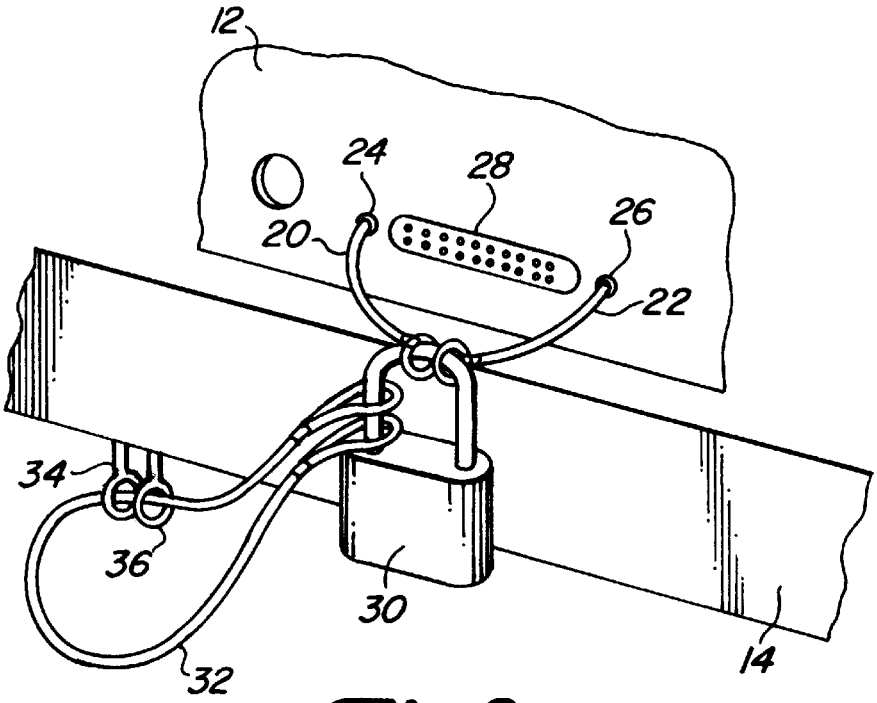
FIG. 2 is a close-up view of the invention as depicted in FIG. 1.

Referring now to the drawings, wherein like reference numerals designate identical or corresponding parts throughout the several views, FIG. 1 depicts a first embodiment of the invention depicted generally at 10 where it is secured to the rear of a computer 12 and to the underside of a computer desk 14. Referring also to FIG. 2, the invention

10 is seen to comprise a pair of threaded eyelet bolts 20, 22 which are screwed into the threaded apertures 24, 26 of an unused serial or parallel port 28. The eyelet bolts 20, 22 are curved so as to permit the eyelets to come into close proximity with each other so they may be secured together by a padlock 30. This of course prevents the eyelet bolts 20, 22 from being unscrewed from the computer 12.

The padlock 30 is then secured to the computer desk 14 by a cable 32 which passes through a pair of eyelet screws 34, 36 screwed into the underside of the desk 14. Again, the use of two closely spaced eyelet screws 34, 36 and a relatively snug cable 32 prevent the eyelet screws 34, 36 from being unscrewed from the desk 14.

In the alternative, the cable 32 of FIGS. 1 and 2 could pass through the eyelet bolts 20, 22 secured to the computer 12 and then be padlocked to the eyelet screws 34, 36.

Figure 3:
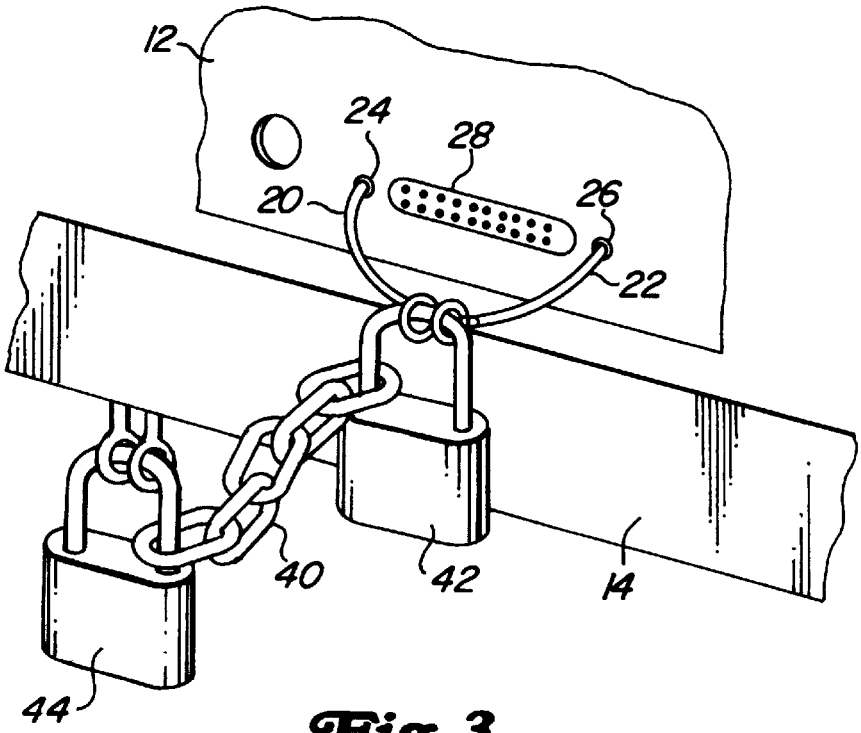
FIG. 3 is a close-up view of a second embodiment of the invention.

A further embodiment of the invention is depicted in FIG. 3 which utilizes a short chain 40 extending between a pair of padlocks 42, 44.

It should be obvious to one skilled in the art that the substance of the invention is the utilization of a pair of eyelet bolts with an unused serial or parallel port and a means of connecting those bolts to an essentially immovable object which also serves to prevent the eyelet bolts from being unscrewed from the computer. The connecting means is invisioned to cover all manners of steel cables and chains, looped around or through or otherwise secured to the immovable object as well as to the eyelet bolts. Therefore, although only a few exemplary embodiments of the invention have been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A system for deterring the theft of personal computers, comprising: in combination (a) a personal computer having at least one of an unused serial and parallel port with threaded securement apertures;

(b) first and second threaded eyelet bolts having an eyelet and a curved intermediate portion and a threaded end for threaded engagement with said threaded securement apertures of said personal computer; and (c) means for preventing the disengagement of said threaded eyelet bolts from said threaded apertures and for attaching said personal computer to a relatively immovable object.

2. A method for deterring the theft of a personal computer, comprising the steps of:

(a) screwing a pair of eyelet bolts into the threaded securement apertures of one of an unused serial and parallel port of said computer, wherein said eyelet bolts have a threaded end, an eyelet end, and a curved intermediate portion;

(b) rotating the eyelet ends of said pair of eyelet bolts in an orbital path about the threaded securement apertures of one of said unused serial and parallel port of said computer to a point wherein the orbital paths are convergent with one another; and (c) a step for attaching said eyelet bolts to a relatively immovable object whereby unscrewing of said eyelet bolts from computer is prevented.

* * * * *